United States Patent [19]

Tabler et al.

[11] Patent Number: 4,466,541

[45] Date of Patent: Aug. 21, 1984

[54] MOLDED CONTAINER WITH INTEGRAL HINGE

[75] Inventors: Charles P. Tabler, Hamilton; Daniel R. Miller, Cincinnati, both of Ohio

[73] Assignees: Buckhorn Material Handling Group Inc., Cincinnati, Ohio; Ekco Products, Inc., Wheeling, Ill.

[21] Appl. No.: 371,999

[22] Filed: Apr. 26, 1982

[51] Int. Cl.[3] ..... B65D 21/06; B65D 51/04

[52] U.S. Cl. ..... 206/506; 220/338; 220/341

[58] Field of Search ..... 206/505, 506, 507; 220/334, 335, 337, 338, 341, DIG. 13

[56] References Cited

U.S. PATENT DOCUMENTS

| | | | |
|---|---|---|---|
| 2,605,296 | 8/1952 | Casey . | |
| 2,733,830 | 2/1956 | Ruskin | 220/338 |
| 3,087,642 | 4/1963 | Caparone . | |
| 3,126,120 | 3/1964 | Crate | 220/343 |
| 3,220,603 | 11/1965 | Bromley . | |
| 3,362,561 | 1/1968 | Bakos | 220/343 |
| 3,480,178 | 11/1969 | Morgan . | |
| 3,655,088 | 4/1972 | Box | 220/337 |
| 3,840,115 | 10/1974 | Ladewig . | |
| 3,960,290 | 6/1976 | Yake . | |
| 4,106,623 | 8/1978 | Carroll | 206/506 |
| 4,109,791 | 8/1978 | Clipson | 206/506 |
| 4,163,495 | 8/1979 | Drader . | |
| 4,342,393 | 8/1982 | Box | 220/338 |
| 4,349,120 | 8/1982 | Nardo | 220/335 |
| 4,349,121 | 8/1982 | Lafferty | 220/341 |

FOREIGN PATENT DOCUMENTS

| | | |
|---|---|---|
| 2286062 | 4/1976 | France . |
| 1245100 | 9/1971 | United Kingdom . |

*Primary Examiner*—George E. Lowrance
*Attorney, Agent, or Firm*—Beall Law Offices

[57] ABSTRACT

A stacking and nesting container, particularly a bakery tray, is provided with bails on two opposed sidewall top edges that are pivotable between a nesting position when the trays may be nested within each other and a stacking position wherein a like tray may have its bottom supported by the bails of a lower tray, and the entire structure is molded of synthetic resin material, without metal parts or separate hinge components. The hinge for the bails is formed by pins molded into the bails and fit within self locking bearing aperature of the sidewalls.

10 Claims, 24 Drawing Figures

MOLDED CONTAINER WITH INTEGRAL HINGE

BACKGROUND OF THE INVENTION

The present invention relates to stackable and nestable containers.

An example of a stackable and nestable container is that of U.S. Pat. No. 4,109,791 issued Aug. 29, 1978, which is commonly owned with the present application. Particularly, this patent relates to a bread tray that may be nested and further which has bails moveable to a stacking position so that a like tray may be stacked thereon. It is a well know advantage to have transport and storage containers that may be nested when empty to thereby occupy less space and that may be stacked upon one another securely when full to protect the contents within them.

SUMMARY OF THE INVENTION

With respect to the production and usage of stackable and nestable containers, such as disclosed in the above mentioned U.S. Pat. No. 4,109,791, it has been found that the commonly employed metal hinge pin has a number of disadvantages, namely: the container is then unsuitable for use in a microwave oven; the hinge pin requires two additional parts to be inventoried and available during assembly of each container; there is some difficulty in assembling three components, namely wall, bail and hinge pin for each end of the container; and any non-metalic hinge pin substitutable for the metal hinge pin, for example with respect to meeting microwave oven requirements, produces additional disadvantages that the cost of the hinge pin may be increased ten fold or more because of a requirement to use an expensive high strength material, which increase in cost is a serious disadvantage in a low cost high volume item such as a shipping container, and the use of a lower cost material would not be satisfactory due to a lack of strength.

The hinge pin for the bail is subjected to considerable stresses, for example forces of the bail portion adjacent the hinge wanting to move upwardly or inwardly due to bending and twisting tendencies caused by stacking loaded containers one upon another in a high stack. Horizontal forces on the hinge pin may further be produced by grasping a bail and pulling a container or stack of nested containers across a support surface. The inventor's analysis has further noted that forces are rarely exerted downwardly on the hinge pin and when they are they are quite small.

With the understanding of the problems of the prior art gained through the above analysis, a hinged connection between the bails and sidewalls of a stacking and nesting container of this type was provided to consist of only portions molded in one piece with either the bail or sidewalls, particularly with cooperating hinge pins and hinge pin bearings. A plurality of hinge pins are provided with the corresponding plurality of bearings. The hinge pins may be entirely on the bail, or entirely on the sidewall, or some of them may be on the bail and some of them on the sidewall, with of course their related bearings being on the other. The hinge pins are of two types as are the bearings, namely: cantilevered hinge pins on the opposite longitudinal ends of the bails that are received within corresponding axial bores, blind or through, which bores have pin engaging surfaces extending 360° around the bore; and hinge pins supported at their opposite axial ends integrally and received within their bearings by radial movement through an outwardly flared assembly slot leading to the bearing that is formd by a wall surface extending from one side of the slot to the other through greater than 180°, and preferably about 270°, so that the assembly is with a snap fit.

BRIEF DESCRIPTION OF THE DRAWING

Further objects, features and advantages of the present invention will become more clear from the following detailed description of a preferred embodiment shown in the accompanying drawing, wherein.

Figure 21:
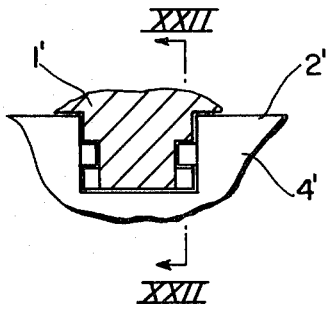
FIG. 21 is a partial cross-sectional view taken through a variation of the connection between the bail and its sidewall.
Figure 22:
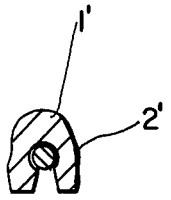
FIG. 22 is a partial cross-sectional view taken along line XXII—XXII of FIG. 21.
Figure 23:
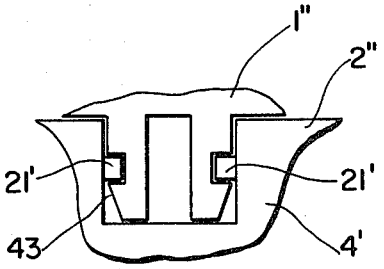
FIG. 23 is a partial view of a further variation of the connection between the bail and its sidewall corresponding to FIG. 21.

Like numerals will be used throughout the drawings to show like parts of the preferred embodiment, and the variations of FIGS. 21–23 indicate the scope of the broader aspects of the preferred embodiment. The disclosure of U.S. Pat. No. 4,109,791 issued Aug. 29, 1978 to Clipson et al and assigned to the assignee of the present invention is incorporated herein in its entirety. The container of the present invention is an improvement of this patented container and for the manner in which the bail may be flipped 90° between a nesting position and a stacking position and the manner in which like containers may thereby be nested and stacked for the present invention is adequately disclosed in this patent and therefore will not be treated in detail herein.

The container of the present invention consists of only three separate parts, namely two bails 1 (and their variations 1' and 1'') and one container body 2 (including its variations 2' and 2''). Each of these parts is molded in one unitary piece from synthetic resin, preferably from polyethylene by injection molding, although other synthetice resin, or more broadly non-metalic, materials may be employed with other methods of molding. Therefore, the container in its entirety consists only of non-metalic material, more specifically synthetic resin, and more specifically molded synthetic resin.

Figure 2:
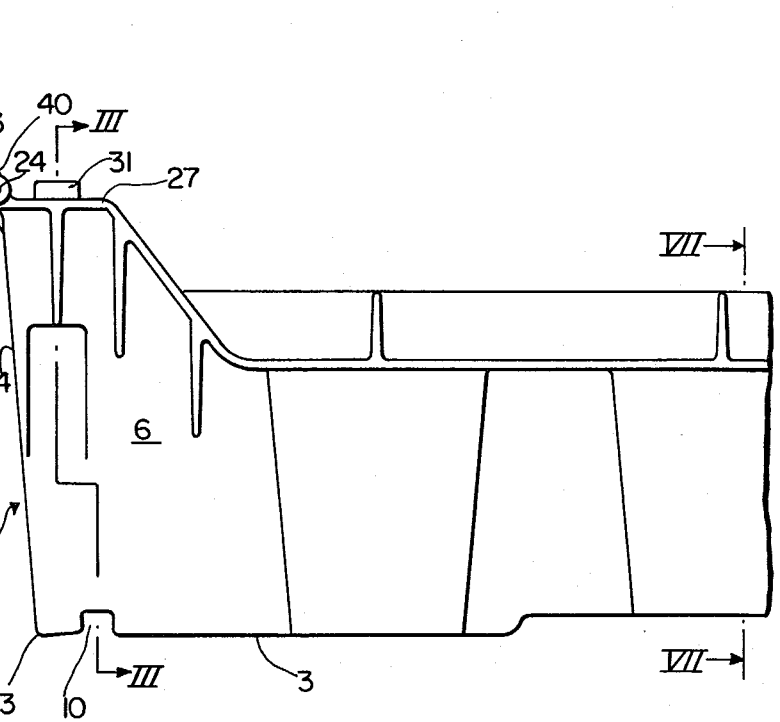
FIG. 2 is one-half of a side elevation view of one of the other opposed sides, as viewed from the right of FIG. 1 and with the other one-half being substantially a mirror image.
Figure 8:
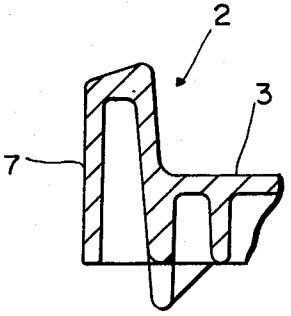
FIG. 8 is a partial cross-sectional view taken along line VIII—VIII of FIG. 9.
Figure 7:
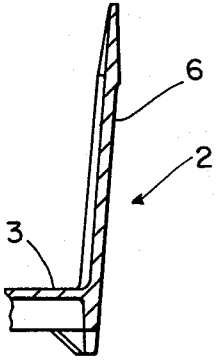
FIG. 7 is a partial cross-sectional view taken along line VII—VII of FIG. 2.
Figure 6:
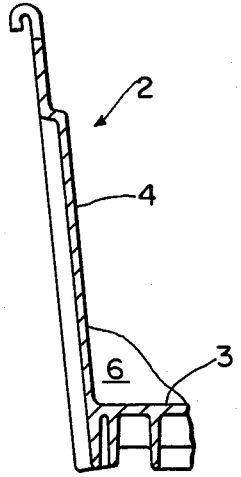
FIG. 6 is a partial cross-sectional view taken along line VI—VI of FIG. 1.
Figure 9:
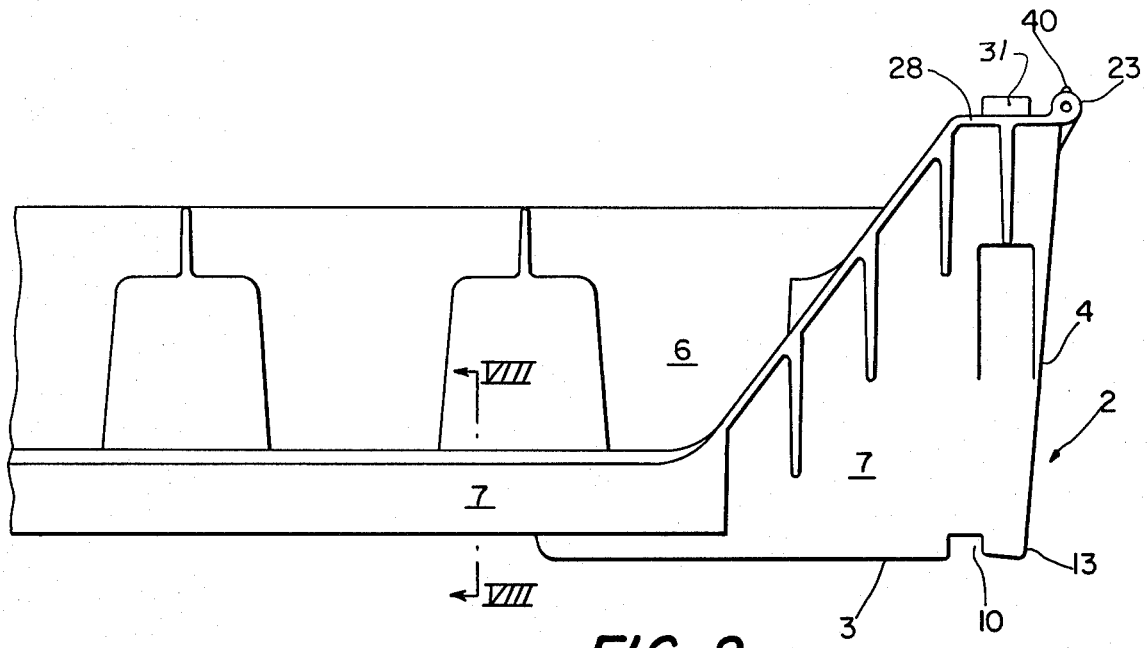
FIG. 9 is a partial side elevation view of the side opposite to the side shown in FIG. 2, with the remaining portion of the illustrated side being a substantial mirror image of that illustrated.
Figure 10:
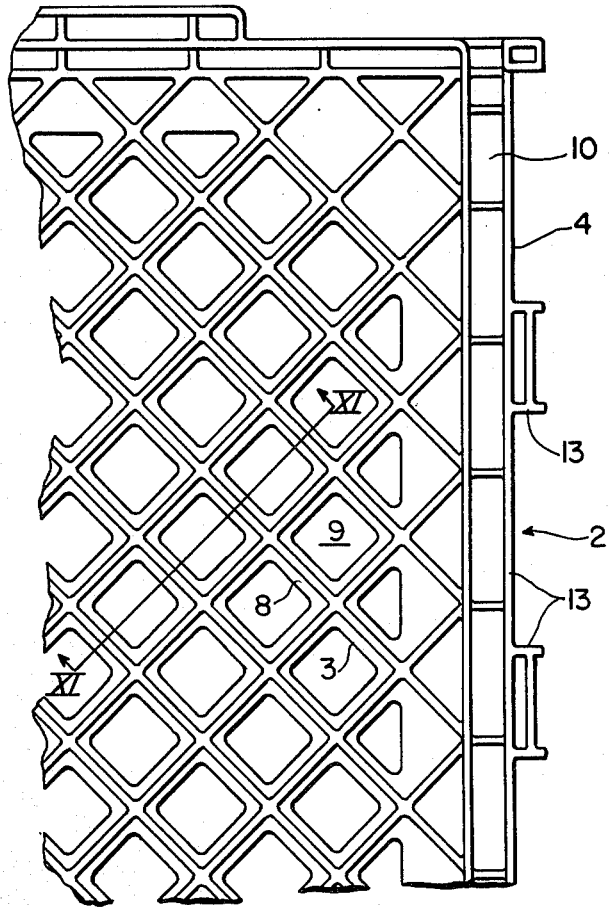
FIG. 10 is a partial bottom view, with portions broken away, of the bottom wall of the container of FIG. 1.
Figure 11:
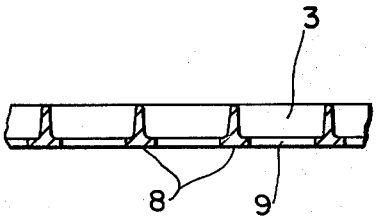
FIG. 11 is a partial cross-sectional view taken along line XI—XI of FIG. 10.
Figure 12:
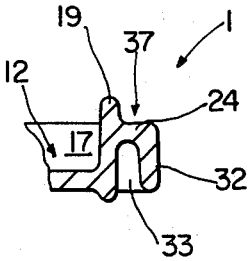
FIG. 12 is a partial cross-sectional view taken along line XII—XII of FIG. 1.

The container body 2 comprises a bottom wall 3 and two pairs of opposed sidewalls 4, 5, 6, 7 that are integrally joined together and integrally extending upwardly from the periphery of the bottom wall. As more particularly shown in FIGS. 3–11, the bottom wall 3 is generally rectangular in plan view, and comprises a grid of T-shaped beams 8, with spaces 9 there between. A through channel 10, as additionally shown in FIGS. 2 and 9, is provided horizontally and parallel to the one pair of sidewalls 4, 5 and adjacent thereto to extend completely between the other pair of sidewalls 6, 7. These channels 10 provide elongated rectangular feet 13 partly formed by the entire lower edge of respective sidewalls 4, 5, which feet are closely received within respective box like apertures 12 of the bails 1, when the bails 1 are assembled and extend horizontally inwardly from their pivot axes in a stacking position wherein a like container may be stacked with its feet 13 within the apertures 12 of the bails of the lower box.

It is seen that the wall 4 is substantially identical to, but a mirror image of, the wall 5 so that only one need be shown or described in detail. The wall 6 of the other pair of sidewalls is substantially higher than its opposed sidewall 7, which is advantageous with respect to the high sidewall 6 providing strength and the low sidewall l7 providing access to goods within the containers for example bakery goods, when the containers, are stacked. In this respect, the wall 7 is constructed of double thickness throughout its height as shown in FIG. 8 to provide beam strength to offset the beam strength lost by its lower height with respect to the sidewall 6. The sidewalls slope outwardly and upwardly from the bottom wall and are so shaped that like containers may be nested within each other when disposed in vertical aligned relationship when the bails are positioned to extend generally vertically upward from their pivot axes or rotated outwardly therefrom.

The bails 1 are identical to each other and are mirror images when assembled to the container body 2. Each bail comprises a generally sheet portion 14, which is generally rectangular shaped and extends over substantially the entire length and width of the bail. With respect to the stacking position of the bail, defined as the sheet portion 14 being generally horizontally extending inwardly from the respective pivot axis 15 and with the container body in an upright position the general directions such as upward, downward, inward, outward, etc. are thereby defined unless otherwise indicated. Each bail is provided with a plurality of downwardly extending reinforcing ribs 16 which are generally parallel to each other and perpendicular to the sides 4, 5, on the bottom surface of the sheet portion 14. The opposed longitudinal edge portions of the sheet portion 14 are each provided with upwardly extending reinforcing and box forming ribs 17, 18 that are parallel to each other and parallel to the sidewalls 4, 5. The sheet portion 14 is further provided with opposed (only one being shown) ribs 19, which are parallel to each other and parallel to the sidewall 6, 7. These ribs 16, 17, 18, 19 are connected together and to the corresponding peripheral edges of the sheet portion 14 to form the above mentioned box like aperture 12, in addition to reinforcing the bails.

A unitary hinge structure is provided on the bails and container body, and consists only of structural elements molded in one piece with the bails and container body. More particularly, the hinge serves to pivotally mount the bails 1 on the upper edge of respective sidewalls 4, 5 so that the bails are pivotally mounted for movement about parallel axes 15 between the above mentioned stacking position and a nesting position rotated upwardly and outwardly from the stacking position, preferably at least approximately 90°, so that the bails will not then interfere with nesting of container bodies. Preferably, the nesting position is such that the bails extend upwardly and slightly outwardly, preferably 5° from the vertical, from their hinge axes so that there will be full nesting of the containers with the bails effectively nesting with respect to corresponding bails of a like nested box.

To this end, a plurality of pivot portions in the form of lugs extend outwardly from the outer edge of each bail, with such pivot portions being longitudinally aligned and spaced from each other, and further the container body sides 4, 5 are each provided along their upper edge with other pivot portions, in the form of lugs, that are correspondingly longitudinally aligned and spaced from each other. The pivot portions are of two types, respectively on the bails and container body. Broadly, one type may be either on the bail or body and the other type on the other, but according to the preferred embodiment, the pivot portions 20 of the bail serve as mounting for the opposed ends of rigidly connected pivot pins 21 that extend between adjacent pivot portions 20 and outwardly cantilevered from the end most pivot portions 20, with all pivot pins 21 for each bail being coaxial and preferably of the same diameter.

The pivot pins 21 are molded from the same material and at the same time homogeneously with the bails, preferably as synthetic resin injected into a mold to simultaneously form the bails in their entirety, including the pivot pins 21. The pivot proportions 20 are further provided with coring apertures 22 that could extend completely through (not shown) or as opposing blind apertures as shown in the drawing, to reduce the amount of material used, generally equalize wall thickness throughout the bails, to provide for uniform cooling, and to correspondingly prevent distortion when removed from the mold. These coring apertures open vertically so that the forming mold portions need move away only vertically and only two mold halves are needed to form the body. The pivot portions 23, in the forms of lugs, are correspondingly spaced from each other along the upper edges of sidewalls 4, 5, to be of a length and spacing so as to interengage, preferably interdigitate, with corresponding pivot portions 20 of corresponding bails, preferably with very small clearance therebetween. Each of these pivot portions contains therein bearing apertures that are aligned coaxially for each sidewall 4, 5. These bearing apertures preferably have bearing wall surfaces forming or at least partially forming bores of a diameter substantially equal to the diameter of corresponsing ones of the pivot pins 21. With respect to the inner pivot portions 23 for each sidewall, the bores 24 preferably extend axially completely therethrough. With respect to the end pivot portions 23, the bores 24 may extend axially completely therethrough or as blind bores opening towards the adjacent pivot portion 23. The apertures 24 for all but the outer end pivot portions 23 have through slots 25 opening radially outward therefrom. Preferably, the slots 25 open downwardly so that no laterally sliding or extra mold parts are needed. The slots 25 preferably diverge downwardly and outwardly so that during assembly, the associated pivot pin 21 may enter the slot 25 and cam apart the slot walls 25 as the pivot pin moves radially inward and the hook-like shape of the pivot portion 23 opens to accept the pivot pin 21 within the bore 24 coaxially, at which time the resiliency of the pivot portion 23, which portion is deformed only resiliently and not permanently, causes the hook like shape of the pivot portion 23 to close to its normal shape and trap therein the pivot pin by a snap-action.

Preferably, the apertures 24 are in the form of bores having circular bore surfaces extending for approximately 330°, and at least substantially greater than 180° to normally prevent removal of the pivot pin 21, even in the downward direction.

Once assembled it will be impossible to disassemble the bails without breakage, although less preferably the structure could be such that pivot pin 21 can be removed downwardly for purposes of replacing a bail, but with far greater effort than its insertion, due to the wall of the bores forming a greater angle with a radius passing through the slot 25 than the walls of the slot 25. Furthermore, the assembly of the pivot pin within the bore 24 is facilitated by being accomplished shortly after the container body and bails are removed from the mold, while they are still hot and easily resiliently deformed.

Figure 16:
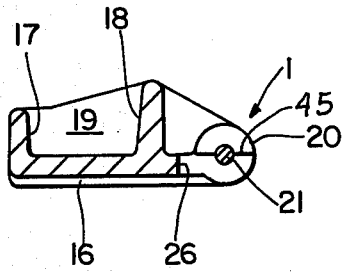
FIG. 16 is a partial cross-sectional view taken along line XVI—XVI of FIG. 13.
Figure 17:
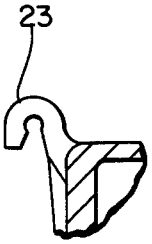
FIG. 17 is an enlarged portion of FIG. 5.
Figure 18:
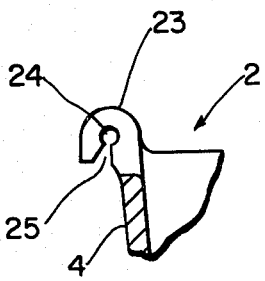
FIG. 18 is an enlarged portion of FIG. 5.

All of the pivot portions of the walls 4, 5 may be formed in the above manner so that assembly of pivot pins is only accomplished radially and further the outer cantilevered pivot pins could be removed (not shown). However, the end pivot portions, that is the four pivot portions for the entire container that are located at the respective four corners of the container body, are provided with bores that have bearing surfaces extending the full 360° around the bore. Each of these bores may be made by having two or more axilly spaced semicylindrical surfaces respectively facing upwardly and downwardly (not shown) as in the U.S. Pat. No. 3,463,345 to Bockenstette issued Aug. 26, 1969, so that together the two or more semicylindrical surfaces for one pivot portion of lug constitute the 360° bore and the advantage is obtained that the bearing may be made with only two mold halves, also each end lug or pivot portion would be provided with only one upwardly opening generally semicircular bearing surface supporting a cantilevered pin. Assembly is by first forming the elongated bail into a bow shape and inserting the corresponding end cantilevered pivot pins axially into the bores of the outermost pivot portions 23 while straightening out the bails and radially inserting the remaining pivot pins through their corresponding slots 25. Preferably, this assembly can only be accomplished, due to the sheet portion 14 being closely spaced as at 26 in FIG. 16, to the pins 21, when the bail is in a specific rotated position, with respect to the axis 15, preferably within a narrow range less than 15° to 20° about a position 180° rotated about the axis 15 from the above mentioned stacking position, hereinafter referred to as the assembly position. This assembly position is preferably with the bail extending horizontally outward and further dictated by the fact that the bail may only be bowed in a plane perpendicular to sheet portion 14.

Figure 24:
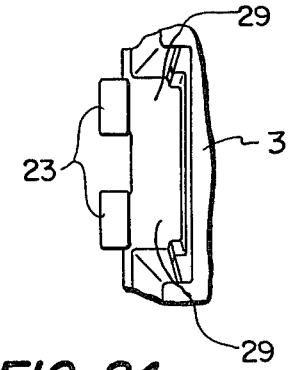
FIG. 24 is a top partial view of the container body.

The bails may easily move between their stacking and nesting position, with the nesting position being slightly outwardly of the vertical, preferably 5°, so that gravity will tend to hold the bail in its nesting position. In its stacking position, each bail rests upon upwardly facing generally horizontal support surfaces 27 of the upper edge of the sidewall 6 and corresponding support surfaces 28 of the upper edges of the sidewall 7 with contact between the bail and such support surfaces being inwardly spaced from the pivot pin axis 15. Further, a plurality of upwardly facing support surfaces 29, as shown in FIG. 24, are provided throughout the length of the upper edge of the opposed walls 4, 5, and again so as to contact the bails inwardly spaced from the pivot axis 15. In this manner, substantially the entire weight of containers stacked above the presently described container will bear upon the bails and be transferred directly to the suport surfaces 27, 28, 29 without materially stressing the pivot pins 21 or the pivot portions 20, 23 and in any event there will be no material forces tending to force the pivot pins downwardly into their slots 25.

Figure 20:
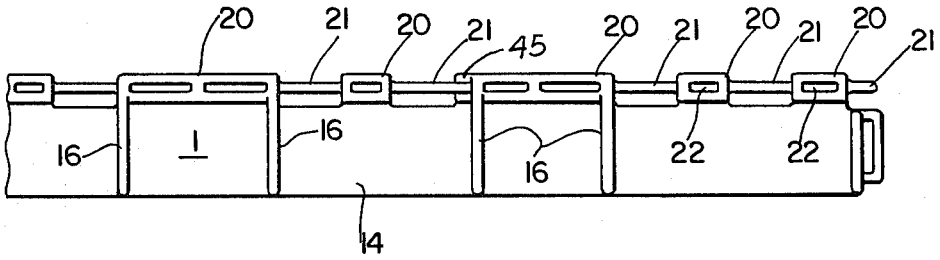
FIG. 20 is a partial bottom view of the bail shown in top view in FIG. 1.

Adjacent the opposite ends of each bail, there is an interlock portion 30, four for the entire container at the corresponding four corners, which is of a generally ring shape as seen in FIG. 20. Each interlock portion opens downwardly from the stacking position to envelope or surround a correspondingly shaped interlock lug 31, four for the respective four corners of the container body, which extends integrally upwardly from the associated support surfaces 27, 28. In portion 30, the outer wall 32 is most important and it may be rigidly secured with respect to the remainder of its bail by various means, which can include one or more of adjacent ribs 19, end walls 33, or top wall 24. The wall 32 positively engages the outermost surface of the interlock lug 31 as seen in FIG. 2 to prevent this portion of the bail from moving inwardly when loaded, that is prevent distortion or bowing of the bail, which is additionally prevented by the above mentioned support surfaces 29. Further, such prevents outward bending of the sidewalls 6, 7 and assures that the bails will securely rest upon their support surfaces 27, 28.

The outer cantilevered pins at each end of the bails provide a particularly valuable function. That is, they can only be disassembled axially and therefore prevent the bail from merely being pulled downwardly from one end, when in its assembly position, thereby preventing disassembly through a zipper-like action. Disassembly is further prevented by the fact that disassembly would normally be tried inadvertently or maliciously when the containers were at normal temperature and not sufficiently resilient to permit disassembly even if one knew how. Disassembly purposely for replacing worn or damaged bails would preferably not be possible, but may be accomplished after the containers had been placed in and removed from ovens to substantially heat them to a temperature wherein they would be easily deformable in a resilient manner for disassembly.

Figure 1:
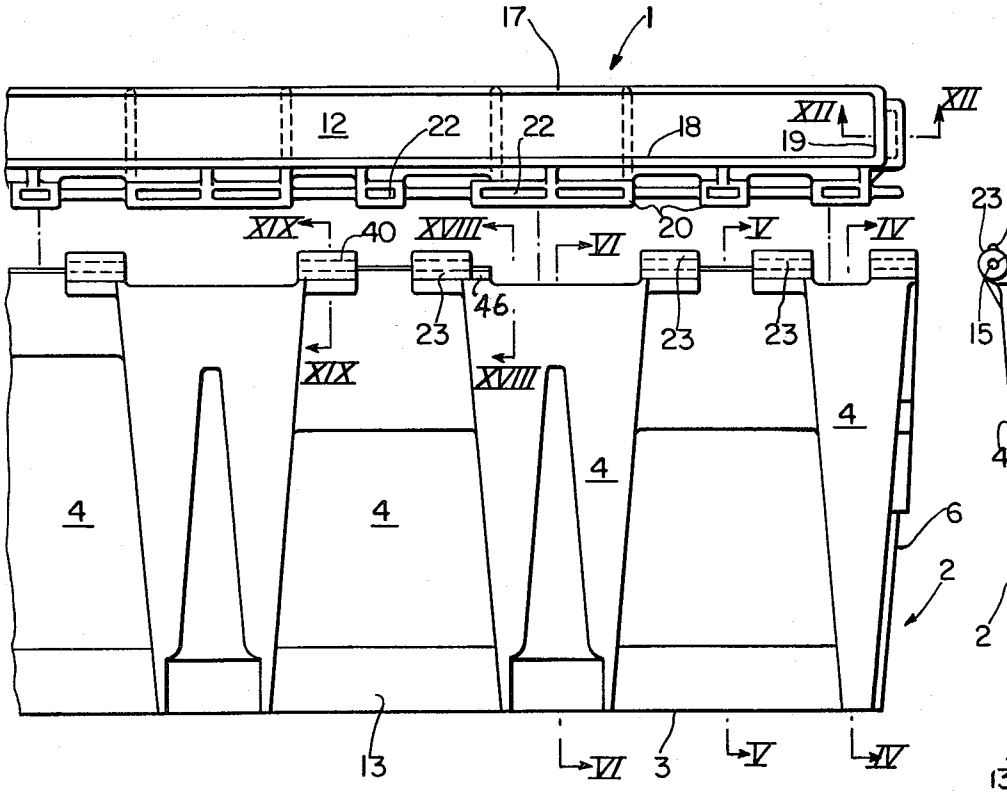
FIG. 1 is one-half of a side elevation view, exploded, of the container of the present invention, with the other one-half beng substantially a mirror image and a corresponding view of the opposed side being substantially identical.
Figure 13:
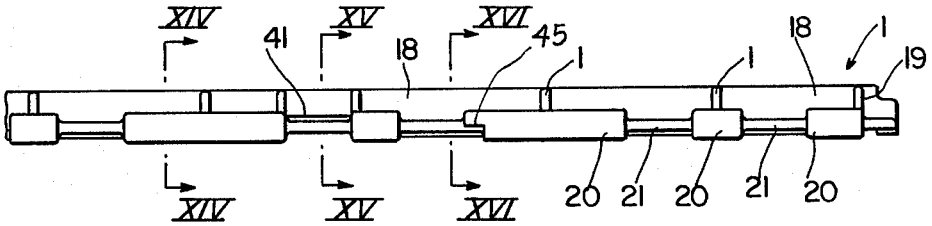
FIG. 13 is an end view of the bail by itself, which is shown in top view in FIG. 1.
Figure 14:
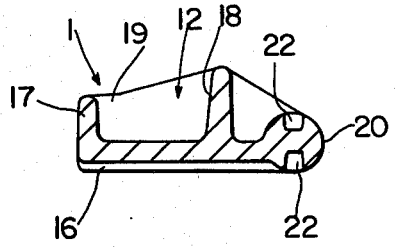
FIG. 14 is a partial cross-sectional view taken along line XIV—XIV of FIG. 13.
Figure 15:
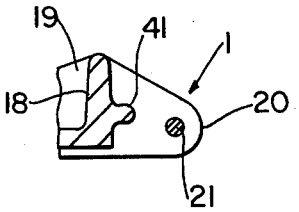
FIG. 15 is a partial cross-sectional view taken along line XV—XV of FIG. 13.
Figure 19:
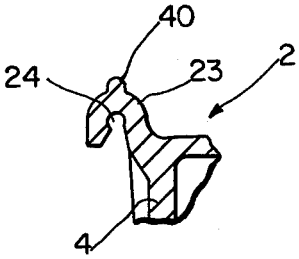
FIG. 19 is a partial cross-sectional view taken along line XIX—XIX of FIG. 1.

To normally prevent the bails from pivoting to their stacking position from their nesting position and further to define the nesting position, one or more of the pivot portions 23 is provided with a detent 40, particularly shown in FIG. 1 and FIG. 19, and the bail at a corresponding location is provided with a detent 41, particularly shown in FIGS. 13 and 15. In the nesting position, the detent 40 and 41 will engage and prevent inward inadvertant rotation of the respective bail about the axis 15 toward the stacking portion. Therefore, of these detents 41 may be overcome as they resiliently cam past each other so that the bails may move between the stacking and nesting portions. These detents 41 are preferable to the hemispherical detent shown in FIG. 8 of U.S. Pat. No. 4,109,791 that wear excessively due to point contact and cam axially, because the present detents have line contact and cam each other radially. The interference between these detent 40, 41 is such in combination with the inherent resiliency of the container body and bails, that the bails may be moved from their nesting position to their assembly position without damaging or excessively wearing the parts. Of course, only one detent may be provided and engage a simple wall portion of the other member. Assembly is facilitated by having the one outside slot wall associated with the detents 40, 41 slope at 30° to the slot center two for the container plane, whereas all other slot walls slope at 15° to the slot center plane.

In FIGS. 21–23, the pivot pins 21 have been modified to be cantilevered pivot pins 21' and the slots 25' and apertures 24' modified to extend axially only the axial length of the stubs of the pivot pins 21'. With respect to FIGS. 21 and 22, portion 23 has been further modified to provide the slot with a snap action cam portion 43 that cooperates with a forked pivot portion 23 to provide a snap action fit in each case as shown. These variations in the pivot pin assembly shown in FIGS. 21–23 are for the purposes of illustrating the broadness of the present invention with respect to the broader aspects, even though the specific aspects shown in the preferred embodiment are in fact preferred according to the narrower aspects of the present invention. Further, FIG. 21 shows that the pivot pins may be provided on the container body whereas the apertures may be provided on the bails.

Figure 5:
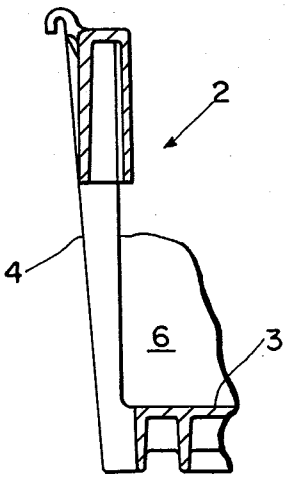
FIG. 5 is a partial cross-sectional view taken along line V—V of FIG. 1.
Figure 4:
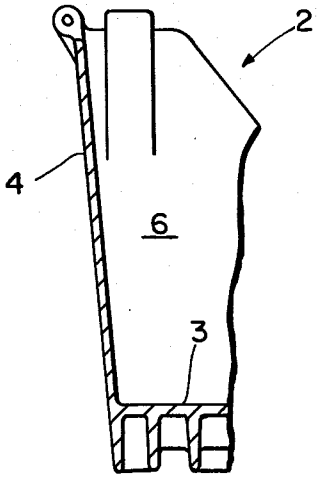
FIG. 4 is a partial cross-sectional view taken along line IV—IV of FIG. 1.
Figure 3:
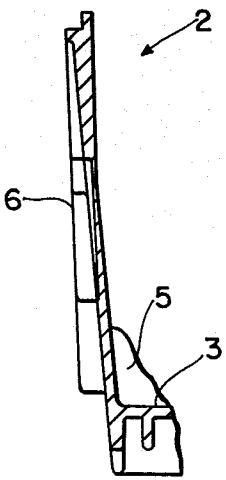
FIG. 3 is a partial cross-sectional view taken along line III—III of FIG. 2.

Rotation stops 45, 46 are provided between at least two adjacent pivot portions of a bail and side wall to positively prevent rotation of a bail outwardly and downwardly from its nesting position at normal temperatures, although they are shaped such that they will not prevent assembly as above described. Similar stops are shown in FIG. 5 of U.S. Pat. No. 4,109,791.

The hinge construction of the present invention may be employed for pivotally connecting container lids or lid portions to upper edges of boxes, and for example may form the hinge means for the lid portions of a container such as shown in the Bockenstette patent, U.S. Pat. No. 3,463,345, which patent is commonly assigned with the present application, according to the broadest aspects of the present invention.

The operation of the present invention along with the method of assembly has been fully disclosed along with the structural description, so that further explanation is unnecessary.

A preferred embodiment has been disclosed for the advantages of its specific details, variations and modifications, and further embodiments have been disclosed to illustrate the broader aspects of the present invention; therefore further modifications, variations and embodiments are contemplated according to the broader aspect of the present invention without prejudicing the advantages of the details, all as determined by the spirit and scope of the following claims.

What is claimed is:

1. A nestable and stackable container, comprising a unitary, one piece, container body of molded synthetic resin material having a bottom wall and two pairs of opposed side walls integrally joined together and integrally extending upwardly from the periphery of said bottom wall;

said side walls being shaped and extending upwardly and outwardly from said bottom wall to permit said container body to be nested within a like container body and the latter to be nested therein when disposed in vertical aligned relationship therewith;

a pair of bails, each being a unitary, one piece, construction of molded synthetic resin;

hinge means unitary in one piece only with each of said bails and one pair of said opposed sidewalls for pivotally connecting said bails to said one pair of sidewalls, respectively, for movement about respective parallel horizontal axes that are parallel to said bottom and the longitudinal extent of said one pair of sidewalls to provide for pivotal movement of said bails relative to said container body between a stacking position wherein each bail extends generally horizontally inwardly from its associated pivot axis into the adjacent interior of the container body toward the opposed sidewall of said one pair of sidewalls to provide respective upwardly facing support stack surfaces, and a nesting position wherein each bail is disposed outwardly of the adjacent interior of the associated sidewall to permit said nesting of two like container bodies;

bail support surfaces on said one pair of opposed sidewalls spaced from the adjacent corresponding pivot axes and engaging the respective bails in their stacking position at contact points spaced radially from said respective pivot axis to resist inward turning movements on said bails;

said bail structures, when in said stacking position, having their support stack surfaces simultaneously engaging a like container stacked thereon in vertical aligned relationship above said container body;

said hinge means comprising a plurality of longitudinally spaced, upwardly extending, first pivot portions of molded synthetic resin integral, in one piece, with the upper edge of each of said one pair of sidewalls, a plurality of longitudinally spaced second pivot portions of molded synthetic resin integral, in one piece, with and along a longitudinal edge of each of said bails that are of a spacing and of a longitudinal length so as to inter-engage longitudinally with said first pivot portions of the associated sidewall of said one pair of sidewalls, a plurality of pivot pins coaxial with a respective pivot axis extending from at least one of said first pivot portions and said second pivot portions, and said pivot pins being constructed of molded synthetic resin integral, in one piece, with said one pivot portions, and the other of said first and second pivot portions having longitudinally extending bearing apertures coaxial with said respective pivot axes and of a diameter substantially equal to the diameter of respective pivot pins;

said second pivot portions integrally and in one piece including means providing assembly of said pivot pins within respective apertures;

said assembly means including slots opening radially from said bearing apertures to permit only radial assembly of said pins through said slots into said bearing apertures only when said bails are in an assembly position that is pivotally spaced from said pivotal movement of said bails relative to said container body between the stacking position and the nesting position; and said bails and said sidewalls having interengaging stop surfaces positively preventing rotation of said bails through said nesting position to said assembly position.

2. The container of claim 1, wherein said apertures include axially aligned cylindrical bores and said slots being wedge shaped of a minimum width less than the diameter of said bores extending radially from said bores to open outwardly and provide for assembly of said pivot pins commonly from only one radial direction through said slots and resilient camming of said slots outwardly to permit passage of said pivot pins into said bores; and said bores being cylindrical bearing surfaces extending over an arc substantially greater than 180° on each side of a slot.

3. The container in claim 2, wherein said pins are on said bails and all of said slots open vertically downwardly.

4. The container of claim 3, wherein said bails, when in said nesting position, extend vertically upwardly from said bores and pivot pins, and have aligned wall portions immediately adjacent and spaced from each pivot pin to positively prevent removal of said pivot pins from said bores through said slots in all but an assembly position wherein said bails extend generally horizontally outwardly from their respective pivot axes.

5. The container of claim 1, wherein said bails and their associated sidewalls have interengaging detent means with detents that physically interfere with movement of each of said bails from said nesting position to said stacking position and generally engage when said bails are in said nesting position, and which include cam means for resiliently camming said detents away from each other to permit movement of said bails from said nesting position toward said stacking position with a substantial nondestructive force, said detents provide line contact parallel to respective axes and said cam means cam said detents radially away from each other, said detents and cam means are radially adjacent and spaced from at least one pivot pin for each bail, and the slot associated with said one pivot pin being generally of greater dimension than the remaining slots.

6. The container of any one of claims 1, wherein said pivot pins include first pivot pins that are each integral at their opposite axial ends with adjacent pivot portions, and cantilevered pivot pins extending axially outwardly from only one adjacent pivot portion and being located at the outermost axial ends of said one sidewalls and said bails; said cantilevered pivot pins being received within respective bores at each of and only at the four corners of said container; the pivot portion receiving therein said cantilevered pivot pins havin pivot pin engaging surfaces in the same radial plane as said slots to positively prevent radial removal of said cantilevered pivot pins and permit only axial assembly of said cantilevered pivot pins into their respective bores by first bowing said bails by laterally displacing their mid-portion and axially inserting said cantilevered pivot pins as said bails are straightened out and radially inserting the remainder of said pivot pins through their slots as said bowed bails are straightened out.

7. A container of claim 2, wherein said pivot pins include first pivot pins that are each integral at their opposite axial ends with adjacent pivot portions, and cantilevered pivot pins extending axially outwardly from only one adjacent pivot portion and being located at the outermost axial ends of said one sidewalls and said bails; said cantilevered pivot pins being received within respective bores at each of and only at the four corners of said container; the pivot portion receiving therein said cantilevered pivot pins having pivot pin engaging surfaces in the same radial plane as said slots to positively prevent radial removal of said cantilevered pivot pins and permit only axial assembly of said cantilevered pivot pins into their respective bores by first bowing said bails by laterally displacing their mid-portion and axially inserting said cantilevered pivot pins as said bails are straightened out and radially inserting the remainder of said pivot pins through their slots as said bowed bails are straightened out.

8. The container of claim 6, wherein the other pair of opposed sidewalls have one upstanding lug adjacent the end of each of said one pair of sidewalls, and said bails have at their opposite longitudinal ends apertures receiving therein respective ones of said lugs at a distant spaced horizontally inwardly from said respective axes when said bails are in said stacking position to prevent spreading of said other sidewalls outwardly when a load is applied to said bails downwardly and to prevent bowing of said bails.

9. A hinge structure between first and second molded synthetic resin members, comprising:

said hinge structure consisting only of parts unitary in one piece with said members by simultaneous molding of homogenous material;

said hinge structure providing relative rotation of said members about a hinge axis between at least a first position and a rotationally spaced second position;

said hinge means comprising a plurality of axially spaced first pivot portions on one of said members, a plurality of axially spaced second pivot portions on the other of said members at an axial spacing and axial length so as to interengage with said first pivot portions, a plurality of pivot pins coaxial with said hinge axis and secured to associated pivot portions of an associated member and received within bores of the other member, and said bores being of a diameter substantially equal to the diameter of their associated pins and coaxial with said hinge axis;

the pivot pins of one of said members including a cantilevered pivot pin at each axial end of said one member, with each cantilevered pivot pin extending axially outward of said one member, and the axially outermost pivot portions of the other member having bores axially receiving therein said cantilevered pivot pins, which bores are at least partially defined by arcuate bearing surfaces positively preventing movement of said cantilevered pivot pins radially out of said bores in one radial direction;

some of said pivot portions including bearing surfaces defining a bore extending circumferentially for greater than 180° and less than 360° joined to a slot radially opening from said bore and having slot sidewalls that have a spacing at said bore substantially less than the diameter of its associated pivot pin to a spacing removed from said bore that is at least about the diameter of its associated pivot pin so that all of said pivot pins other than said cantilevered pivot pins may be assembled only by radially moving them through their respective slots and camming the slot surfaces away from each other resiliently to permit them to enter said bores with a snap action;

said structure being shaped and defined so that one of said members must be bowed with respect to said hinge axis resiliently to only assemble said cantilevered pivot pins axially in their respective bores while simultaneously straightening said bowed members and assembling said remaining pins radially in their respective bores, each of said members includes wall means permitting said assembly in only one relative rotational position of said members with respect to each other, to define an assembly position;

including stop means positively preventing relative rotation of assembled members to said assembly position, all of said pins being integral with one of said members, integrally supported at their opposite axial ends by respectively adjacent pivot portions of said one member, and all of said bores being integrally formed within the pivot portions of the other of said members.

10. A nestable and stackable container, comprising:

a unitary, one piece, container body of molded synthetic resin material having a bottom wall and two pairs of opposed sidewalls integrally joined together and integrally extending upwardly from the periphery of said bottom wall;

said sidewalls being shaped and extending upwardly and outwardly from said bottom wall to permit said container body to be nested within a like container body and the latter to be nested therein when disposed in vertical aligned relationship therewith;

a pair of bails, each being a unitary, one piece, construction of molded synthetic resin;

hinge means unitary in one piece only with each of said bails and one pair of said opposed sidewalls for pivotally connecting said bails to said one pair of sidewalls, respectively, for movement about respective parallel horizontal axes that are parallel to said bottom and the longitudinal extent of said one pair of sidewalls to provide for pivotal movement of said bails relative to said container body between a stacking position wherein each bail extends generally horizontally inwardly from its associated pivot axis into the adjacent interior of the container body toward the opposed sidewall of said one pair of sidewalls to provide respective upwardly facing support stack surfaces, and a nesting position wherein each bail is disposed outwardly of the adjacent interior of the associated sidewall to permit said nesting of two like container bodies;

bail support surfaces on said one pair of opposed sidewalls spaced from the adjacent corresponding pivot axes and engaging the respective bails in their stacking position at contact points spaced radially from said respective pivot axis to resist inward turning movements on said bails;

said bail structures, when in said stacking position, having their support stack surfaces simultaneously engaging a like container stacked thereon in vertical aligned relationship above said container body;

said hinge means comprising a plurality of longitudinally spaced, upwardly extending, first pivot portions of molded synthetic resin integral, in one piece, with the upper edge of each of said one pair of sidewalls, a plurality of longitudinally spaced second pivot portions of molded synthetic resin integral, in one piece, with and along a longitudinal edge of each of said bails that are of a spacing and of a longitudinal length so as to inter-engage longitudinally with said first pivot portions of the associated sidewall of said one pair of sidewalls, a plurality of pivot pins coaxial with a respective pivot axis extending from at least one of said first pivot portions and said second pivot portions, and said pivot pins being constructed of molded synthetic resin integral, in one piece, with said one pivot portions, and the other of said first and second pivot portions having longitudinally extending bearing apertures coaxial with said respective pivot axes and of a diameter substantially equal to the diameter of respective pivot pins;

said pivot pins including first pivot pins that are each integral at their opposite axial ends with adjacent pivot portions, and cantilevered pivot pins extending axially outwardly from only one adjacent pivot portion and being located at the outermost axial ends of said one pair of sidewalls and said bails; said catilevered pivot pins being received within respective bores at each of and only at the four corners of said container; the pivot portion receiving therein said cantilevered pivot pins having pivot pin engaging surfaces in the same radial plane as said slots to positively prevent radial removal of said cantilevered pivot pins and permit only axial assembly of said cantilevered pivot pins into their respective bores by first bowing said bails by laterally displacing their mid-portions and axially inserting said cantilevered pivot pins as said bails are straightened out and radially inserting the remainder of said pivot pins through their slots as said bowed bails are straightened out.

* * * * *